US005131855A

United States Patent [19]

Pickering

[11] Patent Number: 5,131,855

[45] Date of Patent: Jul. 21, 1992

[54] GROUNDING STUD ASSEMBLY

[75] Inventor: Richard W. Pickering, St. Ann's, Canada

[73] Assignee: Westinghouse Electric Corp., Pittsburgh, Pa.

[21] Appl. No.: 706,820

[22] Filed: May 29, 1991

[51] Int. Cl.[5] ..... H01R 4/66

[52] U.S. Cl. ..... 439/92; 439/521; 439/921

[58] Field of Search ..... 439/92, 94, 186, 480, 439/521, 921; 174/556, 6

[56] References Cited

U.S. PATENT DOCUMENTS 3,701,839 10/1972 Smith .
3,787,797 1/1974 Kurz .
3,915,540 10/1975 Thompson et al. .
4,082,393 4/1978 Gamble .
4,195,198 3/1980 Krause .
4,500,157 2/1985 Huffnagle et al. .
4,620,755 11/1986 Yonkers et al. .
4,744,765 5/1988 DeLeo .
4,822,289 4/1989 DeLeo .
4,859,192 8/1989 DeLeo ..... 439/92
4,885,428 12/1989 Roberts ..... 439/92 X
4,941,834 7/1990 DeLeo .

*Primary Examiner*—Eugene F. Desmond
*Attorney, Agent, or Firm*—Aileen C. Addessi

[57] ABSTRACT

The grounding stud assembly for grounding electrical equipment comprises a grounding stud having one end for connection to a grounding clamp and an opposite end for connnection to a bus system at either a bus splice joint or cable termination. A cover is positioned over the grounding clamp receiving end and over an insulated elongated portion of the grounding stud for insulating the grounding stud to prevent inadvertent discharge into the environment. The cover comprises an annular ring for engagement with an annular retaining collar positioned on the elongated portion for securing together the cover and grounding stud. The cover includes an eyelet for facilitating removal of the cover from a safe working distance. Due to an overlap of the insulating material of the elongated portion of the grounding stud and of the cover, the grounding stud assembly provides an extension of the creep or strike distance between adjacent grounding studs, thereby enabling the grounding stud assembly to comply with the applicable standards.

14 Claims, 1 Drawing Sheet

GROUNDING STUD ASSEMBLY

BACKGROUND OF THE INVENTION

1. Field of the Invention

This invention relates to an apparatus for grounding electrical equipment and, more particularly, to a grounding stud assembly for providing a safe method of grounding a bus system.

2. Description of the Prior Art

During the inspection or repair of equipment, such as switchgear, safety practices require that all potentially "live" circuits be grounded using appropriate grounding devices and methods. If the switchgear is inadvertently energized during the inspection or repair and the equipment is not grounded, an operator may be seriously injured and the equipment may be damaged.

To connect the equipment to ground, a plurality of grounding studs are connected to the bus system of the equipment. To comply with applicable standards, such as creep or strike distances, the equipment to the environment may have to be mounted staggered or installed with barriers.

The grounding studs are insulated from the environment to prevent any inadvertent discharges from the equipment to the environment. To apply the grounding clamp to the grounding stud for grounding the equipment, the insulation must be removed from the grounding stud to expose the bare bus for applying the safety grounds. If the insulation utilized is tape, an operator must cut the tape from the bus joint exposing the operator to potentially live circuits.

There are several types of grounding studs and insulated covers. One such device is disclosed in U.S. Pat. No. 4,941,834 issued Jul. 17, 1990 to DeLeo entitled "Universal High Voltage Ground Stud Insulating System". The ground stud insulating system comprises a ground stud for receiving a ground clamp and having a threaded shank for fastening to a bus. A first insulative cylinder is arranged over the ground stud on one side of the load terminal bus and has an eyelet to facilitate the use of a "hotstick" by an operator to remove the first insulative cylinder from the ground stud. A second insulative cylinder is attached to the ground stud on the opposite side of the load terminal bus to prevent the formation of a discharge when the bus is energized. The first and the second cylinders having internal threads are attached to the ground stud by utilizing a plurality of washers having threads. However, to fully insulate the system, an insulated cylinder must be utilized on each side of the load terminal bus. Also, to remove the insulated cylinder to attach the ground clamp, the insulated cylinder must be unthreaded from the ground stud.

Therefore, what is needed is a grounding stud assembly which complies with the strike and creep distance requirements of the applicable standards, which can be utilized at either a cable termination or at a bus splice joint, and which conveniently facilitates grounding the equipment at a safe working distance.

SUMMARY OF THE INVENTION

The grounding stud assembly for grounding electrical equipment comprises a grounding stud having one end for connection to a grounding clamp and an opposite end for connection to a bus system at either a bus splice joint or cable termination. An insulated elongated portion is positioned between the ends of the grounding stud. A cover is positioned over the grounding clamp receiving end of the grounding stud for insulating the grounding stud to prevent inadvertent discharge into the environment during non-grounding periods. The cover comprises an annular ring for engagement with an annular retaining collar positioned on the elongated portion for securing together the cover and grounding stud, enabling the cover to be installed on an inverted grounding stud. The cover includes an eyelet for facilitating removal of the cover from a safe working distance.

A mounting member is utilized for securing the grounding stud to the bus system, thereby eliminating the need to insulate each side of the grounding stud, which is necessary when installing the grounding stud through an insulated bus.

Due to an overlap of the insulating material of the elongated portion of the grounding stud and of the cover, the grounding stud assembly provides an extension of the creep or strike distance between adjacent grounding studs, enabling the grounding stud assembly to comply with the applicable standards without requiring the grounding studs to be mounted staggered or installed with barriers. When properly installed, the insulated ground stud maintains the insulating systems integrity by meeting the phase-to-phase and phase-to-ground strike distances as required in the applicable standards.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

The invention described herein provides a grounding stud assembly which utilizes a grounding stud having an elongated portion for compliance with the applicable standards and a cover for insulating the grounding stud, which is easily removable for exposing the grounding stud for grounding the equipment. The grounding stud assembly may be used, for example, in medium voltage metal clad switchgear with insulated bus systems at cable termination or at bus splice joints.

Figure 1:
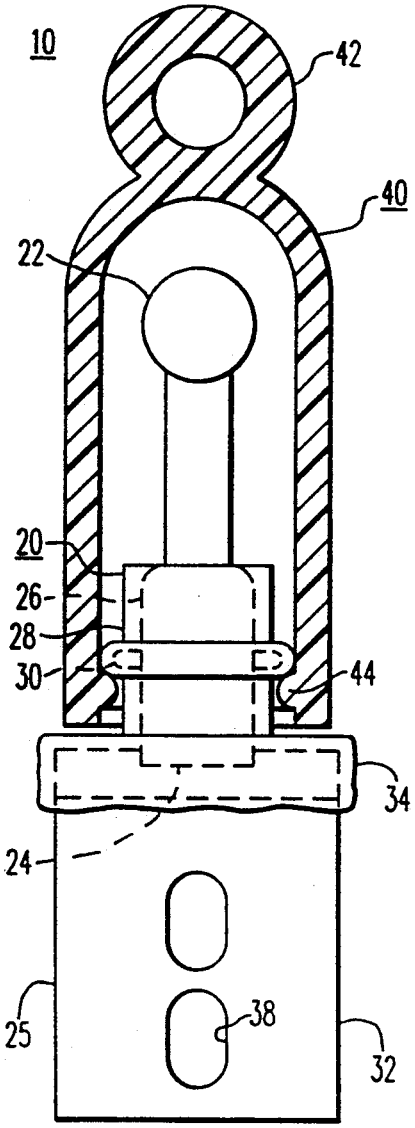
FIG. 1 is a front view, partially in section, of a grounding stud assembly including a grounding stud and a removable insulated cover.

Referring to FIG. 1, a grounding stud assembly, referred to generally as 10 includes a grounding stud 20. The grounding stud 20 has a first end 22 for receiving a grounding clamp and a second end 24 for connection to a mounting member 25. The first end 22 is a grounding stud ball for use with a corresponding ground clamp (not shown), such as an AB Chance Ground Clamp Style #C600-2100, which may be rated for 30,000 amps for 30 cycles and 43,000 amps for 15 cycles. The dimensions and type of the grounding stud used in the grounding stud assembly 10 may vary to allow utilization of the grounding stud with the various grounding clamps available on the market.

Figure 2:
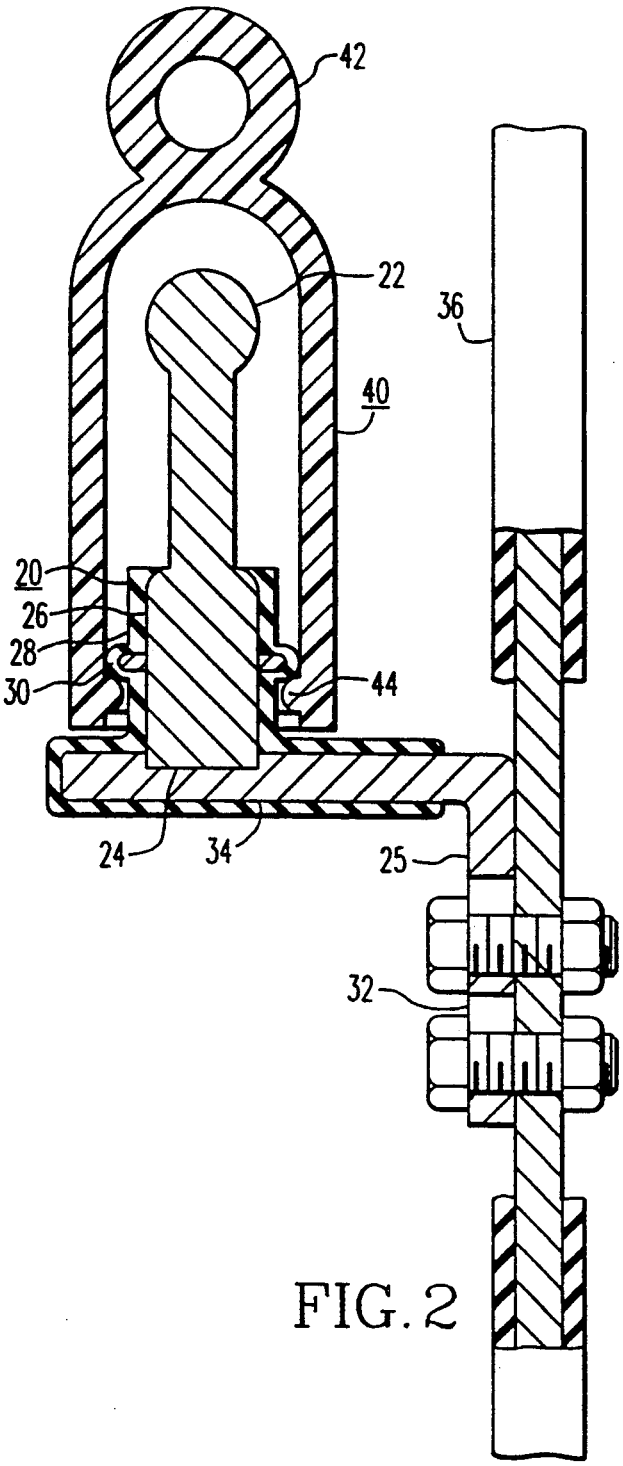
FIG. 2 is a sectional side view of the grounding stud assembly illustrated in FIG. 1 and connected at a bus splice joint of a bus system.

Referring to FIGS. 1 and 2, an elongated portion 26 is positioned between the first end 22 and the second end 24. The elongated portion 26 is a cylindrical shaft, which may be made from a metal, such as copper. A standard ground clamp may be clamped onto the elongated portion 26 beneath the stud ball for grounding the equipment. The elongated portion 26 is insulated, such as by using bed fluidized insulation 28 with a dielectric rating of 1 kV per mil and a minimum applied thickness of 95 mils. The elongated portion 26 further comprises an annular retaining collar 30. The retaining collar 30 is a spring retaining ring having a slot (not shown) for installation of the retaining collar 30 onto the elongated portion 26. Alternatively, the retaining collar 30 may be integrally formed with the shaft of the elongated portion 26 or may be integrally formed with the insulation 28.

Referring to FIG. 2, the second end 24 of the grounding stud 20 is attached to the mounting member 25, such as by a brazing process. The mounting member 25 has a first end 32 and a second end 34 and is bent at approximately 90 degrees therebetween for providing a surface, or first end 32, to attach the grounding stud assembly 10 to a conductor of a bus system 36, such as one connected with switchgear equipment, and for providing a surface, or second end 34, to attach the grounding stud 20 to the mounting member 25. The angle between the first end 32 and the second end 34 of the mounting member 25 may be any angle sufficient to facilitate the attachment of a grounding clamp onto the grounding stud 20.

The first end 32 of the mounting member 25 has a plurality of openings 38, which are slotted holes sized for installation of the grounding stud 20 on standard A.N.S.I. drilled bus systems. FIG. 2 illustrates the first end 32 of the mounting member 25 fastened to a bus splice joint of the bus system 36. The second end 34 of the mounting member 25 has a recess for receiving the second end 24 of the grounding stud 20 for attaching the grounding stud 20 to the mounting member 25. A portion of the second end 34 is insulated with the insulation 28.

Referring again to FIGS. 1 and 2, the grounding stud assembly 10 also comprises a cover 40. The cover 40 is a cylindrical shell having a closed end and an open end. The cover 40 is positioned over the first end 22 and over the elongated portion 26 of the grounding stud 20. The cover 40 is made from an insulating material, such as a self extinguishing PVC material, for insulating the grounding stud 20 to prevent inadvertent discharge from the grounding stud 20 to the environment.

An eyelet 42 is integrally formed on the cover 40 from the insulating material and is positioned at the closed end of the cover 40. Alternatively, the eyelet 42 may be attached to the cover 40. The eyelet 42 facilitates removal of the cover 40 from the grounding stud 20. A removal tool (not shown) is inserted through the eyelet 42 and lifts the cover 40 from the grounding stud 20, thereby enabling an operator to remove the cover 40 from a safe working distance.

The cover 40 further comprises an annular ring 44 positioned on the inside diameter of the cover 40. The ring 44 may be integrally formed with the cover 44 or may be attached to the cover 44. As the cover 40 is positioned over the grounding stud 20, the annular ring 44 snaps over the retaining collar 30 securing together the cover 40 and the grounding stud 20. The engagement of the grounding stud 20 and the cover 40 enables the grounding stud 20 to be mounted inverted without the cover 40 separating from the grounding stud 20. Alternatively, the cover 40 may comprise an annular groove (not shown) positioned on the inside diameter of the cover 40 corresponding to the annular retaining collar 30 of the elongated portion 26. An engagement of the retaining collar 30 within the groove would secure together the cover 40 and the grounding stud 20.

The second end 34 of the mounting member 25 is larger than the second end 24 of the grounding stud 20. When the cover 40 is installed on the grounding stud 20, the insulation 28 covering the portion of the second end 34 of the mounting member 25 overlaps the insulating material of the cover 40. Also, the insulating material of the cover 40 overlaps the insulation 28 on the elongated portion 26.

The strike distance, which is measured through air, and the creep distance, which is measured across the surface, are determined by measuring the distance from a first grounding stud exposed conductor, along the length of a first insulated post, under the edge of a first cover, through the air or along the surface to the next phase, under the edge of a second cover of an adjacent grounding stud, across the length of a second insulated post, and to a second grounding stud exposed conductor. The creep or strike distance between adjacent grounding studs is extended by utilizing the elongated portion 26 and the overlap of insulation of the cover 40 and of the elongated portion 26 when the cover 40 is installed on the grounding stud 20. With an extended creep distance across the surface of the insulated post in addition to the in air distance between the phases, the grounding stud assembly 10 complies with the strike and creep distances as required in the applicable standards, such as A.N.S.I.

For a particular application, a specific quantity of grounding studs are required. Due to the extended creep distance, the grounding studs can be installed closer to one another, thereby reducing the overall size of the assembly and meeting existing standard switchgear design dimensions.

OPERATION

Referring to FIGS. 1 and 2, the second end 24 of the grounding stud 20 is attached to the second end 34 of the mounting member 25. The second end 34 of the mounting member 25 is installed on a bus system 36 by utilizing the plurality of openings 38. After the grounding stud 20 is attached to the bus system 36, the point of installation to the bus system 36 is retaped or insulated employing standard practices used on a bus joint splice or cable termination.

To utilize the grounding stud assembly 10 to ground the bus system 36, from a safe working distance, an operator inserts a removal tool (not shown), such as a hot stick, into the eyelet 42 of the cover 40. The operator lifts the cover 40 disengaging the retaining collar 30 from the annular ring 44. The dangerous procedure of cutting insulation tape away from the point of ground application to expose bare potentially "live" circuits is eliminated. Using standard grounding tools, the operator applies the safety grounds from a safe working distance.

When the grounding clamp is removed from the grounding stud 20, the cover 40 is positioned over the first end 22 and over the elongated portion 26 of the grounding stud 20 to insulate the grounding stud 20 for preventing inadvertent discharge into the environment.

Therefore, the invention provides a grounding stud assembly which complies with the applicable standards, which can be installed in various bus systems, and which can be safety used to facilitate grounding of the equipment.

I claim:

1. A grounding stud assembly, comprising:

a grounding stud having an end for connection to a grounding clamp, an opposite end for connection to a bus system, and an insulated elongated portion positioned between said ends;

a cover positioned over said end for connection to a grounding clamp and over said insulated elongated portion of said grounding stud for insulating said grounding stud; and an annular retaining collar positioned on said insulated elongated portion for engagement with an annular ring positioned on said cover for securing together said cover and said grounding stud.

2. The grounding stud assembly according to claim 1, wherein said grounding stud is a grounding stud ball for connection to a corresponding grounding clamp.

3. The grounding stud assembly according to claim 1, wherein said cover further comprises an eyelet positioned at an end of said cover for accommodating a lifting tool for removing said cover from said grounding stud.

4. The grounding stud assembly according to claim 1, further comprising a mounting member attached to an end of said grounding stud and having a plurality of openings for installing said grounding stud on said bus system.

5. The grounding stud assembly according to claim 4, wherein said mounting member has an insulated portion for providing further insulation to said grounding stud assembly.

6. The grounding stud assembly according to claim 1, wherein said cover comprises PVC material.

7. The grounding stud assembly according to claim 1, wherein said insulated elongated portion is insulated with fluidized bed insulation.

8. The grounding stud assembly according to claim 4, wherein said mounting member has a first end positioned substantially perpendicular to a second end of said mounting member, said first end attached to said bus system and said second end attached to said grounding stud, for securing said grounding stud to said bus system.

9. A grounding stud assembly, comprising:

a grounding stud having a first end, a second end, and an insulated elongated portion, said first end including a grounding clamp receiving portion for connection to a grounding clamp and said insulated enlongated portion positioned between said first end and said second end;

a cover positioned over said first end and over said insulated elongated portion of said grounding stud for insulating said grounding stud; and a mounting member having a first end attached to said bus system and having a second end attached to said second end of said grounding stud for securing said grounding stud to said bus system.

10. The grounding stud assembly according to claim 9, further comprising an annular retaining collar positioned on said insulated elongated portion for engagement with an annular ring positioned on said cover for securing together said cover and said grounding stud.

11. The grounding stud assembly according to claim 9, wherein said grounding clamp receiving portion of said grounding stud is a grounding stud ball for connection to a corresponding grounding clamp.

12. The grounding stud assembly according to claim 9, wherein said cover further comprises an eyelet positioned at an end of said cover for accommodating a lifting tool for removing said cover from said grounding stud.

13. The grounding stud assembly according to claim 9, wherein said mounting member further comprises at least one opening for securing said grounding stud to said bus system.

14. The grounding stud assembly according to claim 9, wherein said mounting member is partially insulated.

* * * * *